US007331729B2

(12) United States Patent
Tong et al.

(10) Patent No.: US 7,331,729 B2
(45) Date of Patent: Feb. 19, 2008

(54) HIGHLIGHT INK MARKER WITH AN AUTOMATIC MAGNETIC CLOSURE APPARATUS

(76) Inventors: Kun Yuan Tong, 2308 W. Doublegate Dr., Albany, NY (US) 31721; John T. Tong, 2490 American River Dr., Sacramento, CA (US) 95825

( * ) Notice: Subject to any disclaimer, the term of this patent is extended or adjusted under 35 U.S.C. 154(b) by 0 days.

(21) Appl. No.: 11/463,760

(22) Filed: Aug. 10, 2006

(65) Prior Publication Data

US 2007/0048064 A1 Mar. 1, 2007

Related U.S. Application Data

(63) Continuation-in-part of application No. 10/943,471, filed on Sep. 17, 2004, now abandoned.

(51) Int. Cl.
*B43K 5/16* (2006.01)

(52) U.S. Cl. ..... 401/107; 401/108

(58) Field of Classification Search ..... 401/99, 401/100, 107–109, 115
See application file for complete search history.

(56) References Cited

U.S. PATENT DOCUMENTS

| | | | |
|---|---|---|---|
| 2,438,231 | A | 3/1948 | Schultz et al. |
| D149,897 | S | 6/1948 | McFayden |
| 4,168,129 | A | 9/1979 | Herrnring |
| 4,176,979 | A | 12/1979 | Saida |
| 5,022,775 | A | 6/1991 | Inoue et al. |
| 6,048,124 | A | 4/2000 | Kawabe |
| 6,394,677 | B2 | 5/2002 | Wang |
| 6,799,918 | B1 | 10/2004 | Scolnik |
| 6,830,402 | B2 | 12/2004 | Sunatori |
| 2006/0062631 | A1 | 3/2006 | Tong |

*Primary Examiner*—Huyen Le
(74) *Attorney, Agent, or Firm*—Womble Carlyle Sandridge & Rice, PLLC

(57) ABSTRACT

A highlight ink marker comprises an inner ink tube, an outer support tube, an automatic magnetic closure apparatus, a washer, a dumbbell-shaped spring coil and an olive-shaped spring ring. The automatic magnetic closure apparatus comprises of a magnet having a central canal to allow the passage of the small ink wick tube of the inner ink tube and a nonmetal block having a bottom hole and a concave hollow to contain a metal ball. The olive-shaped spring ring is installed in two slots of the top outer tube of the outer support tube to catch the top step of the inner ink tube to keep the marker open. The dumbbell-shaped spring coil surrounds the small ink wick tube and is placed in between the washer and the bottom step of the inner ink tube to push the inner ink tube outward.

12 Claims, 5 Drawing Sheets

HIGHLIGHT INK MARKER WITH AN AUTOMATIC MAGNETIC CLOSURE APPARATUS

RELATED APPLICATIONS

This application is a Continuation-In-Part of U.S. patent application Ser. No. 10/943,471 which was filed on Sep. 17, 2004.

BACKGROUND OF THE INVENTION

A highlight ink marker evaporates quickly, if left uncapped. Therefore a user has to cap the highlight ink marker quickly with two hands after using it.

SUMMARY OF THE INVENTION

Highlight ink maker with an automatic magnetic closure apparatus utilizes magnetism to attract a metal ball to close its opening. A highlight ink marker with an automatic magnetic closure apparatus has a magnet that has a central canal for the passage of an ink wick tip and attracts a metal ball to cover the opening of central canal. When a highlight ink marker with an automatic magnetic closure apparatus is pushed downward, its ink wick tip pushes the metal ball away and emerges from the opening of ink marker. When the ink wick tip of a highlight ink marker with an automatic magnetic closure apparatus retracts into the central canal, the metal ball is automatically attracted to cover the central canal by magnetism. There is a washer to close the other end of the central canal to create an airtight central canal to prevent the ink from evaporating.

DETAILED DESCRIPTION OF THE DRAWINGS

DETAILED DESCRIPTION

Figure 1:
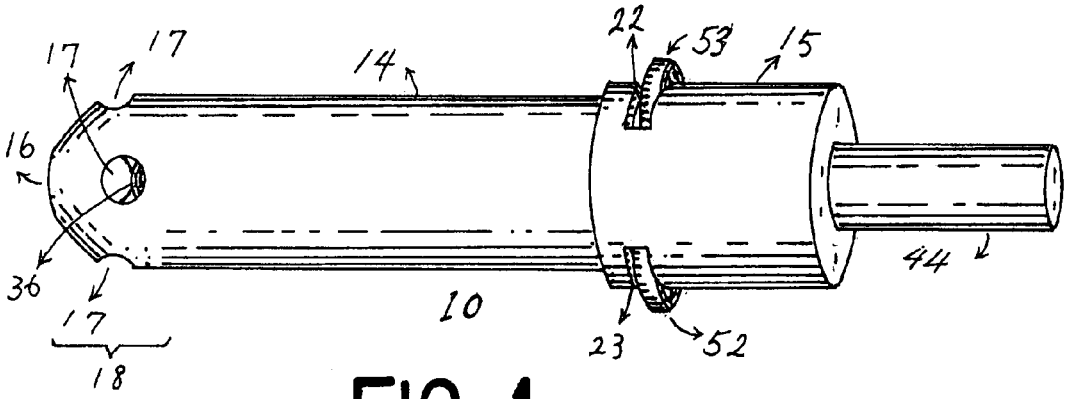
FIG. 1 is a perspective view of a highlight ink marker with an automatic magnetic closure apparatus in closed status.
Figure 2:
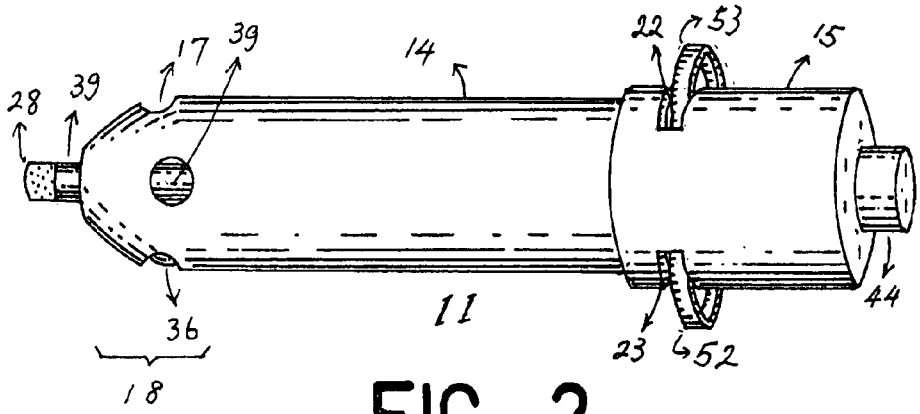
FIG. 2 is a perspective view of a highlight ink marker with an automatic magnetic closure apparatus in open status.
Figure 3:
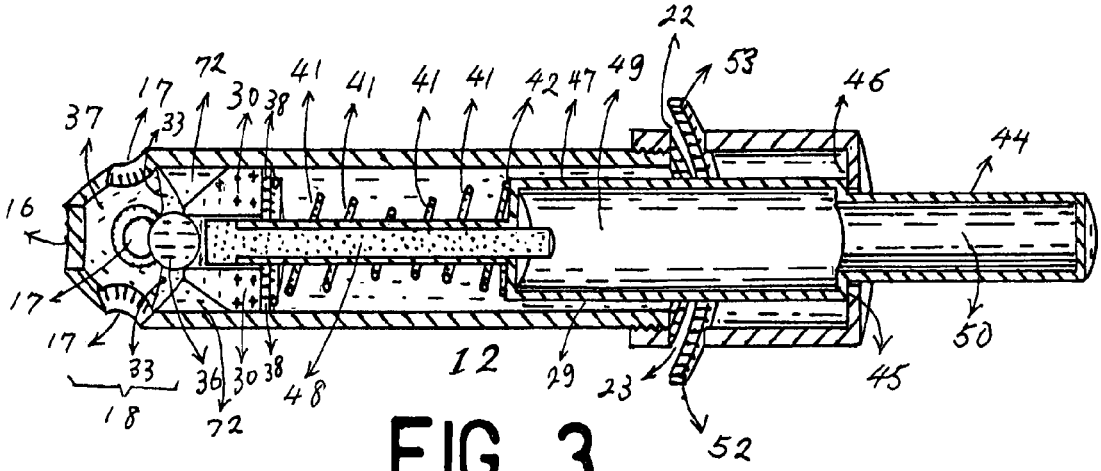
FIG. 3 is a section view of a highlight ink marker with an automatic magnetic closure apparatus in closed status.
Figure 4:
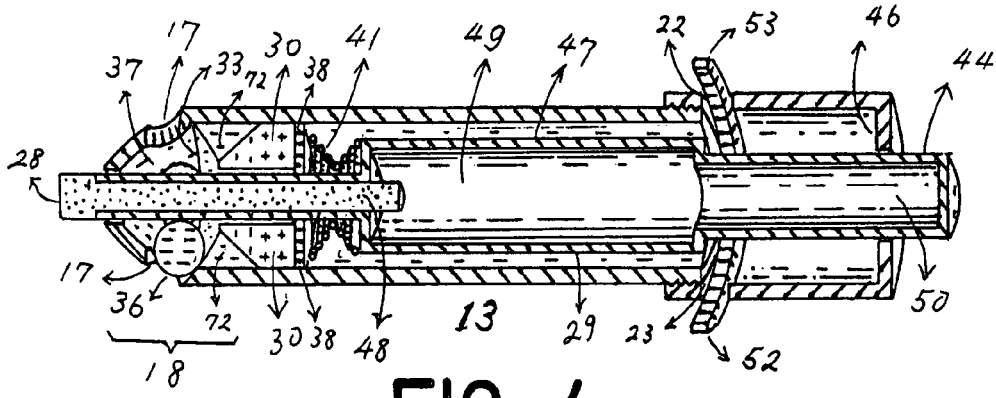
FIG. 4 is a section view of a highlight ink marker with an automatic magnetic closure apparatus in open status.
Figure 5:
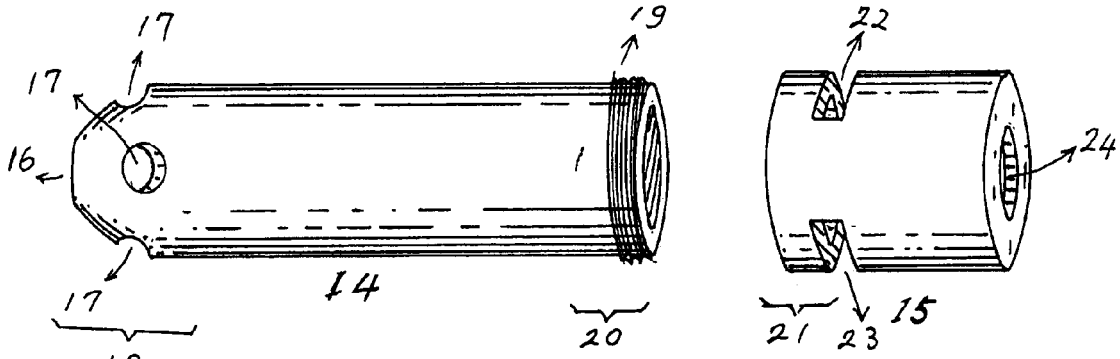
FIG. 5 is a perspective view of the outer support tubes of a highlight ink marker with an automatic magnetic closure apparatus.
Figure 6:
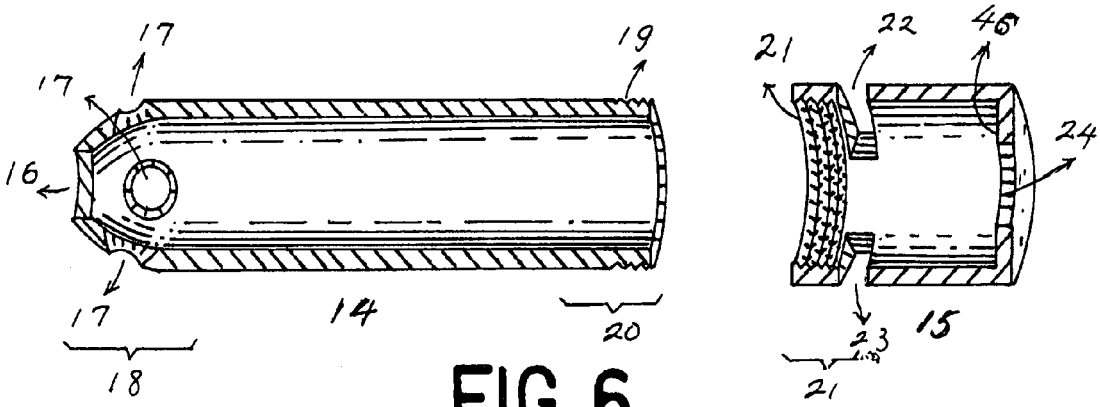
FIG. 6 is a section view of the outer support tubes of a highlight ink marker with an automatic magnetic closure apparatus.
Figure 7:
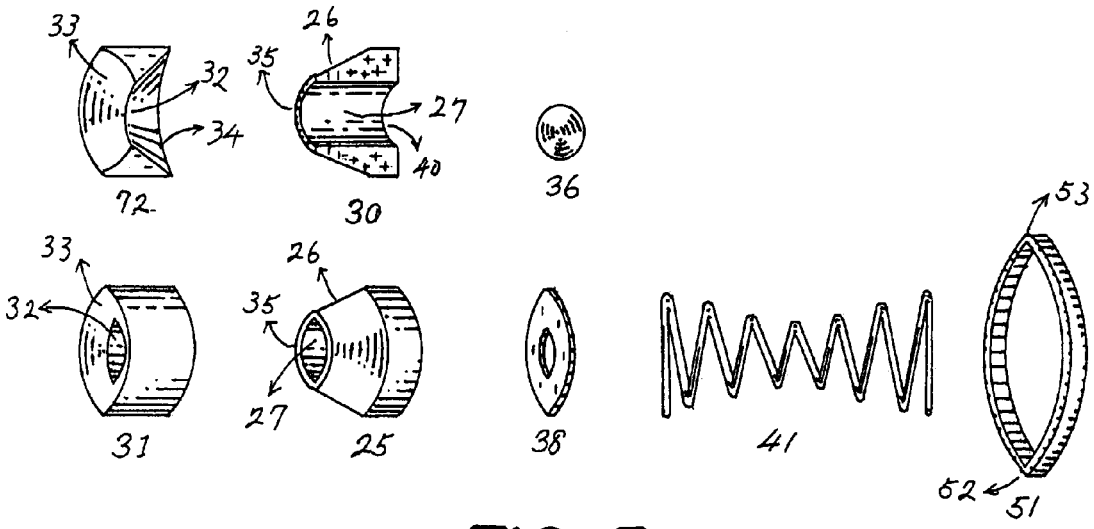
FIG. 7 are perspective and section views of a nonmetal cylindrical block, cone-shaped magnet, metal ball, washer, dumbbell-shaped spring coil and olive-shaped spring ring of a highlight ink marker with an automatic magnetic closure apparatus.
Figure 8:
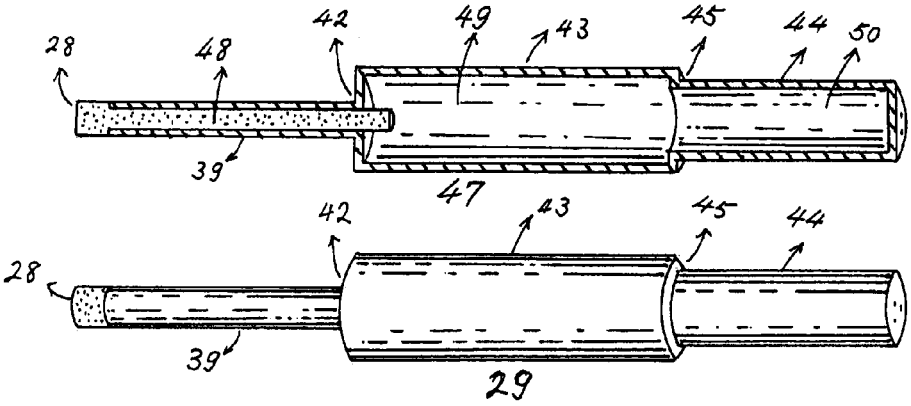
FIG. 8 are perspective and section views of an inner ink tube of a highlight ink marker with an automatic magnetic closure apparatus.

Referring now in detail to the drawings, numeral 10 of FIG. 1 illustrates a highlight ink marker with an automatic magnetic closure apparatus in closed status. Numeral 11 of FIG. 2 illustrates a highlight ink marker with an automatic magnetic closure apparatus in open status. Numeral 12 of FIG. 3 illustrates a section view of a highlight ink marker with an automatic magnetic closure apparatus in closed status. Numeral 13 of FIG. 4 illustrates a section view of a highlight ink marker with an automatic magnetic closure apparatus in open status. Numeral 14 of FIG. 5 illustrates an outer bottom tube and numeral 15 of FIG. 5 illustrates an outer top tube. Outer bottom tube 14 has an opening 16, multiple identical nose holes 17 at the nose end 18 and threads 19 at the top threaded end 20, as illustrated in FIGS. 5 and 6. Outer top tube 15 has an internally threaded end 21, two identical rectangular slots 22, 23 and a top opening 24 as illustrated in FIGS. 5 and 6. Numeral 25 of FIG. 7 illustrates a cone-shaped magnet that has a cone-shaped top 26 and a central canal 27 that allows the passage of ink wick tip 28 of inner ink tube 29 as illustrated in FIG. 8. Numeral 30 of FIG. 7 illustrates a section view of cone-shaped magnet 25 with cone-shaped top 26 and a central canal 27. Numeral 31 of FIG. 7 illustrates a nonmetal cylindrical block that has an hour-glass shaped hollow center that contains a central hole 32 and two concave hollows 33 and 34.

Numeral 72 is a section view of a nonmetal cylindrical block 31 as illustrated in FIG. 7. The concave hollow 34 is fixed onto the cone-shaped top 26 of a cone-shaped magnet 25. The central hole 32 of nonmetal cylindrical block 31 covers the top opening 35 of central canal 27 of cone-shaped magnet 25 as illustrated in FIGS. 3, 4 and 7. Numeral 36 of FIG. 7 illustrates a metal ball whose diameter is greater than that of the top opening 35 of central canal 27 of cone-shaped magnet 25. The magnetism of cone-shaped magnet 25 attracts metal ball 36 to cover its top opening 35 as illustrated in FIGS. 3, 4 and 7. The concave hollow 33 of nonmetal cylindrical block 31 of FIG. 7 and the nose end 18 of outer bottom tube 14 create a nose chamber 37 to confine the metal ball 36 inside as illustrated in FIGS. 3, 4, 5 and 7. The multiple identical nose holes 17 of the nose end 18 of outer bottom tube 14 provide additional room for metal ball 36 to rest when it is pushed away from the top opening 35 of central canal 27 by ink wick tip 28 of inner ink tube 29 as illustrated in FIGS. 2, 4, 5 and 7.

The cone-shaped magnet 25 and the concave hollow 33 of nonmetal cylindrical block 31 make the top opening 35 have greater magnetism than any place else at concave hollow 33. Therefore, metal ball 36 is always attracted to cover the top opening 35 of central canal 27 of cone-shaped magnet 25 when the highlight ink marker with an automatic magnetic closure apparatus 12 is closed as illustrated in FIG. 3. Numeral 38 of FIG. 7 illustrates a washer that surrounds ink wick tube 39 tightly and seals bottom opening 40 of coned shaped magnet 25 to create an airtight central canal 27 as illustrated in FIGS. 3, 4 and 7. Numeral 41 of FIG. 7 illustrates a dumbbell-shaped spring coil that surrounds ink wick tube 39 of inner ink tube 29 and lies between washer 38 and bottom step 42 of middle ink tube 43 of inner ink tube 29 as illustrated in FIGS. 3, 4, 7 and 8. Dumbbell-shaped spring coil 41 can be squeezed to be a coil of two or three layers for space saving purposes. Top end tube 44 of inner ink tube 29 emerges from the top opening 24 of outer top tube 15 as illustrated in FIGS. 1, 3, 5 and 8.

The top step 45 of middle ink tube 43 stops at cap 46 of outer top tube 15 as illustrated in FIGS. 3, 4, 6 and 8. Numeral 47 of FIG. 8 illustrates a section view of an inner ink tube 29. Numeral 48 of FIG. 8 illustrates an ink wick that is placed inside the ink wick tube 39. Numeral 49 of FIG. 8 is an ink chamber of ink tube 43. Numeral 50 of FIG. 8 is an ink chamber of top ink tube 44. Ink chambers 49 and 50 of FIG. 8 are connected. Numeral 51 of FIG. 7 illustrates an olive-shaped spring ring that is placed in two identical rectangular slots 22 and 23 of outer top tube 15 and catches top step 45 of middle ink tube 43 of inner ink tube 29 to keep a highlight ink marker with an automatic magnetic closure apparatus 11 open when the top end tube 44 is pushed downward to a degree that top step 45 of middle ink tube 43 passes down below olive-shaped spring stop ring 51 as illustrated in FIGS. 2, 4, 5, 6 and 8.

Figure 9:
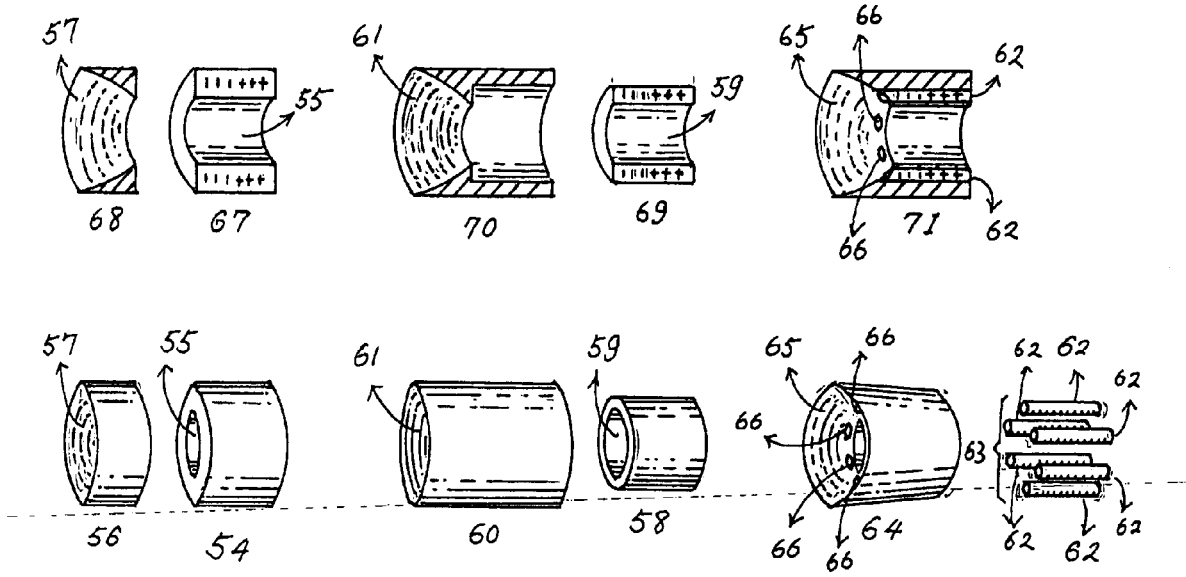
FIG. 9 are perspective and section views of three other versions of a magnet and nonmetal block of a highlight ink marker with an automatic magnet closure apparatus.

When the olive-shaped spring ring 51 is squeezed at both its ends 52 and 53, it opens wider to release the top step 45 of middle ink tube 43 to let dumbbell-shaped spring coil 41 push inner ink tube 29 upward to close highlight ink marker 10 as illustrated in FIGS. 1, 3 and 7. Additional embodiments of the automatic magnetic closure apparatus are shown in FIG. 9. Cylindrical magnet 54 has a central canal 55 and its correspondent nonmetal block 56 has a bowl-shaped central hollow 57. A cylindrical magnet 58 has a central canal 59 and its correspondent nonmetal cylindrical block 60 has a cylindrical central hollow 61. Multiple identical rod-shaped magnets 62 are arranged in a rosette-form 63 and its correspondent nonmetal cylindrical block 64 has a funnel-shaped central hollow 65 and multiple identical canals 66 to load the multiple identical rod-shaped magnets 62. Numeral 67 is a section view of cylindrical magnet 54 and numeral 68 is a section view of cylindrical nonmetal block 56 as illustrated in FIG. 9. Numeral 69 is a section view of cylindrical magnet 58 and numeral 70 is a section view of cylindrical nonmetal block 60 as illustrated in FIG. 9. Numeral 71 is a section view of an automatic magnetic closure apparatus that is made of one set of identical magnet rods 62 that are arranged in a rosette-form 63 and its correspondent nonmetal block 64 as illustrated in FIG. 9. Numeral 72 is a section view of a nonmetal cylindrical block 31 as illustrated in FIG. 7.

The metal ball 36 can be replaced by a magnetic ball. When a metal ball 36 is replaced by a metal ball, the cone-shaped magnet 25 can be replaced by a cone-shaped metal. Of course a magnetic ball 36 and a coned-shaped magnet 25 can be used together. The same technique can be applied to metal ball 36 and multiple identical rod-shaped magnets 62. A Highlight Ink Marker 10 user can turn the Highlight Ink Marker 10 upside down to let metal ball 36 or magnetic ball 36 drop to cover the top opening 35 of cone-shaped magnet 25 to close the Highlighter Ink Marker 10. The same technique can be applied to the version of multiple identical rod-shaped magnets 62.

Several embodiments of the present invention are specifically illustrated and/or described herein. However, it will be appreciated that modifications and variations of the present invention are covered by the above teachings and within the purview of the appended claims without departing from the spirit and intended scope of the invention.

What is claimed:

1. A highlight ink marker with an automatic magnetic closure apparatus comprising a metal ball, a magnet, a nonmetal block between the metal ball and magnet, an outer support tube, and an inner ink tube; wherein said metal ball is untethered and moves along a surface of said nonmetal block;

wherein said magnet has a cone shape and a central canal for the passage of said inner ink tube;

wherein said nonmetal block has a central hole and two cone-shaped hollow ends in which one hollow end fixes onto the cone-shaped magnet and the other hollow end contains said metal ball.

2. The marker of claim 1 wherein said outer support tube is composed of an outer bottom tube and an outer top tube.

3. The marker of claim 1 wherein said outer support tube houses said metal ball, said nonmetal block, and said magnet.

4. The marker of claim 1 wherein said metal ball is attracted by magnetism to said magnet to close said central canal.

5. The marker of claim 1 wherein said outer support tube has multiple holes at one end to provide additional space for said metal ball to rest.

6. The marker of claim 1 wherein said outer support tube had two identical rectangular slots and contain an olive-shaped spring ring.

7. The marker of claim 1 wherein said inner ink tube is composed of a middle ink tube, a smaller ink wick tube at one end and a smaller top end tube on the other end.

8. The marker of claim 7 wherein a step between said middle ink tube and said smaller ink wick tube contains a dumbbell-shaped spring coil and a step between said middle ink tube and said smaller top end tube contains said olive-shaped spring ring.

9. The marker of claim 7 wherein a washer between said magnet and said middle ink tube surrounds said smaller ink wick tube.

10. The marker of claim 7 wherein said inner ink tube is placed inside said outer support tube with said ink wick tube passing through said magnet.

11. The marker of claim 8 wherein said olive-shaped spring ring has its narrowest diameter smaller than that of said middle ink tube in order to catch and stop said step between said middle ink tube and said smaller top end tube and can be squeezed to open wider to release said step.

12. A highlight ink marker with an automatic magnetic closure apparatus comprising a magnetic ball, a metal portion, a nonmetal block between the magnetic ball and metal portion, an outer support tube, and an inner ink tube; wherein said magnetic ball is untethered and moves along a surface of said nonmetal block;

wherein said metal portion has a cone shape and a central canal for the passage of said inner ink tube;

wherein said nonmetal block has a central hole and two cone-shaped hollow ends in which one hollow end fixes onto the cone-shaped metal portion and the other hollow end contains said magnetic ball.

* * * * *